United States Patent [19]

Pahnke

[11] 4,064,734

[45] Dec. 27, 1977

[54] HAMMER FORGING PRESSES

[75] Inventor: Hans J. Pahnke, Dusseldorf, Germany

[73] Assignee: Pahnke Engineering G.m.b.H. & Co. KG, Dusseldorf, Germany

[21] Appl. No.: 683,078

[22] Filed: May 4, 1976

[51] Int. Cl.[2] ..... B21J 13/04

[52] U.S. Cl. ..... 72/455

[58] Field of Search ..... 72/455, 456, 26–31, 72/453.01, 453.18; 100/214, 53

[56] References Cited

U.S. PATENT DOCUMENTS

| | | | |
|---|---|---|---|
| 1,260,745 | 3/1918 | Bell | 72/456 |
| 1,653,030 | 12/1927 | Zeh | 100/214 |
| 1,954,651 | 4/1934 | Sherman | 100/214 |
| 2,230,288 | 2/1941 | Dinzl | 100/214 |
| 3,030,879 | 4/1962 | Lasko | 100/214 |
| 3,081,725 | 3/1963 | Treer | 100/53 |
| 3,389,653 | 6/1968 | Hany | 100/214 |
| 3,397,568 | 8/1968 | Pahnke | 100/214 |
| 3,408,849 | 11/1968 | Jetschmann | 100/214 |

*Primary Examiner*—C.W. Lanham
*Assistant Examiner*—Gene P. Crosby
*Attorney, Agent, or Firm*—Buell, Blenko & Ziesenheim

[57] ABSTRACT

A forging press is provided having two U-shaped vertical frame components on opposite sides of the forging axis and at an angle thereto connected to a top and a bottom transom by at least four tie rods extending from the top to the bottom transom and within the U-shaped vertical members so as to be shielded from radiant heat of the work. Strain gauges are provided on the tie rods to measure and control tension.

5 Claims, 3 Drawing Figures

HAMMER FORGING PRESSES

This invention relates to hammer forging presses and particularly to frames for hammer forging presses having uniquely good accessibility for forging tools.

Hammer forging presses are, per se, old. It is well known that such hammer forging presses require especially good accessibility for the forging tools and yet be rigid and accurate. It has been the practice in designing press frames to so design them to enable a tool replacement in both main shafts of the machine. However, the customary four-column design, which has been applied to presses with top and bottom drive, and which has been generally used in prior art presses, does not satisfy all the requirements of frame rigidity and guide accuracy. Even additional constructions with tubular columns and internal tie rods, which have been proposed, could not improve the guide condition. The column construction has, therefore, been increasingly replaced by the frame construction.

Compared to the tubular column construction, the frame construction has the advantages of surface guides which can be constructed to be adjustable, and the advantage of greater rigidity of the frame against eccentric stress. For the presses in frame constructions, the press frames which are shaped like chain links are, if at all possible, designed in one piece, as for example presented in German patent applications 2,223,708 and 2,231,589.

Because of weight and transport problems the one-piece press frames can be built for presses with a maximum pressure of 3,000 to 4,000 Mp only. For larger forging presses the frame is divided into a lower transom, an upper transom, and 2 side-beams, e.g. Industrieanzeiger nr 84 (Industrial News nr. 84), and Forging Information nr 5, Oct. 6, 1970, FIG. 6.

In hammer forging presses with divided frames, which have been heretofore proposed, the side-beams are thicker at the ends and hold the upper and lower transom together with hook-shaped projections. The bending moment, which is present at stress times, is absorbed by short anchor bolts. There are also frame constructions in which the frame parts are held together by wire wrapping. However, these constructions have the additional disadvantage that no cylinder can be housed in the upper or lower transom. Therefore, they are not suitable for the mostly long cylinders of hammer forging presses.

The construction of divided press frames for hammer forging presses, which have been built so far, is expensive and requires a high machine weight. The vertical frame parts, which have to transfer simultaneously the tractive force from the pressing force, and the bending forces from the eccentric stress, require very large dimensioning. Hook-shaped connections with the upper and lower transoms are expensive and heavy. The subject of this invention is, therefore, a frame construction which combines the advantages of the proven leaning frame for the hammer forging press, with only 2 vertical frame parts, with a lighter and more economical construction.

The present invention provides a hammer forging press having a frame construction comprising two vertical frame components on opposite sides of the forging axis and at an angle thereto, said vertical side components being U-shaped and connected to a top transom and a bottom transom forming a complete press frame with at least four tie rods. Preferably the tie rods are housed within the U-shaped section, which U-shaped section is closed toward the center of the press to shield the tie rods from radiant heat from the work. The stress on the tie rods is measured and controlled by measuring instruments such as strain gauges (tension measuring strips) and the change of tensile stress is utilized for controlling the eccentric stress of the press.

In the foregoing general description of this invention certain objects, purposes and advantages of this invention have been set out. Other objects, purposes and advantages of this invention will be apparent from a consideration of the following description and the accompanying drawings in which.

Figure 1:
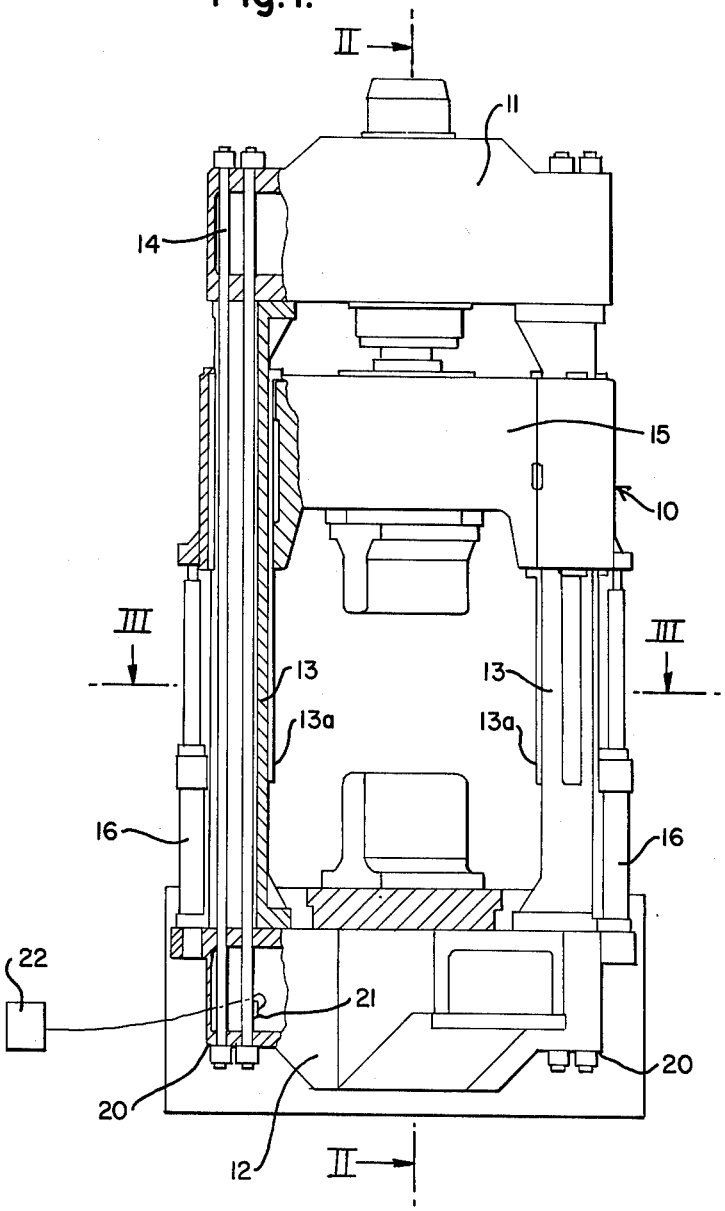
FIG. 1 is a front elevational view, partially in section, of a forging press according to this invention.
Figure 2:
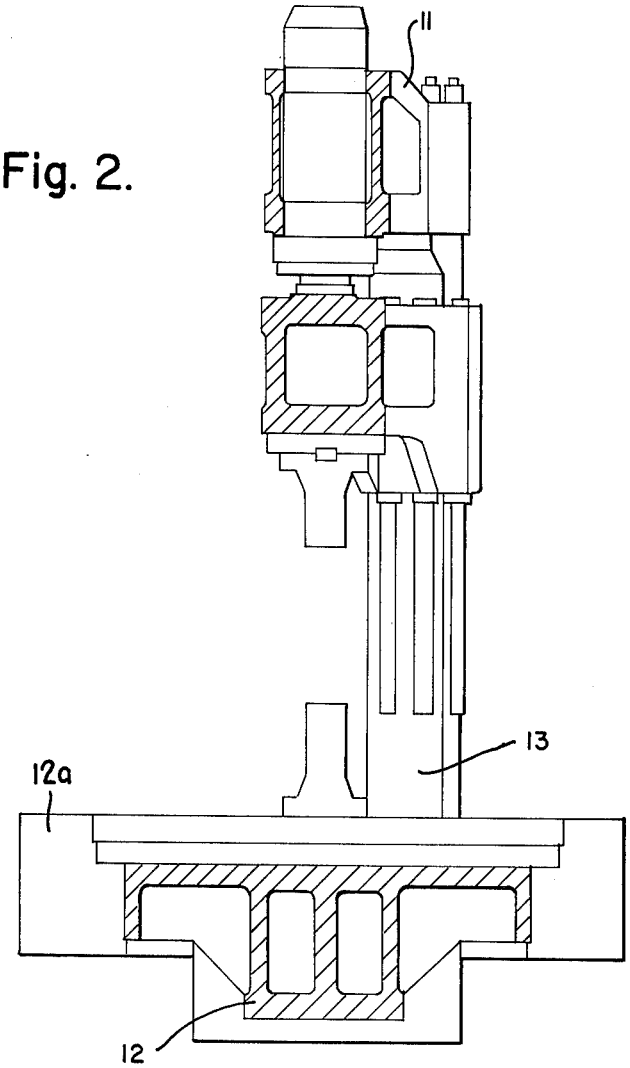
FIG. 2 is a section on the line II—II of FIG. 1.
Figure 3:
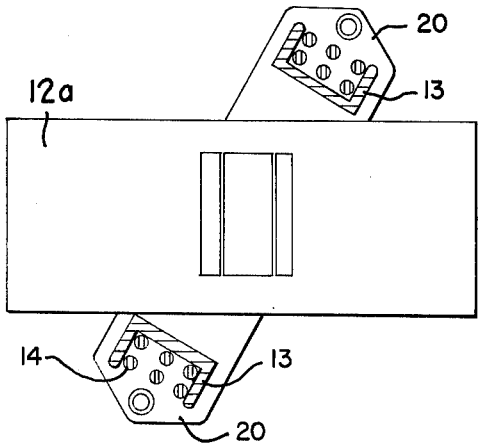
FIG. 3 is a section on the line III—III of FIG. 1.

Referring to the drawings a forging press 10 according to this invention is illustrated having a top transom 11 and a bottom transom 12 including a bed **12*a* connected to each other by U-shaped side frames 13 and a number of tie rods 14. The dimensions and the number of the tie rods 14 are chosen in such a manner that these parts can be produced out of rolled material and do not have to be worked on in the shaft area. The tie rods 14 are prestressed and thus produce a pressure addition in the vertical frame components 13. These U-shaped frame components carry the surface guides 13*a* for the movable transom 15. Their dimensions are such that they can absorb the occurring side stresses and the bending tension which is present during the eccentric forging. The tie rods 14** are free of bending tensions and can therefore get exposed to relatively high stress. Constructions are known, indeed, from general press designs and particularly from the drop forge press design in which the upper and lower beams are put together by using intermediate components with several tie rods. These constructions, however, cannot be used in hammer forging press designs because of their insufficient accessibility. (Compare German patent application 2,047,771).

The U-shaped design for vertical frame components, which is presented in this invention, supplies the required rigidity for the two main axes against eccentric stress, protects the internal tie rods from heat stress, and moreover, gives the possibility to house pipes between the tie rods for the supply of operating fluid to the working cylinders 16. Since anchors transfer only pure tractive force, a control of possible overloading is relatively easy to achieve through a simple tensile measurement. During the eccentric stress of the press the tensile stress changes in the tie rods 14, and most of all in the 4 tie rods 14 which are on the outer corner points of the press frame. The measured change of the tensile stress in these tie rods, for example measured with tension measuring strips (strain gauges) 21, can therefore be used to indicate through measuring instruments directly the amount of electricity during the use of the press, and to set off a signal to controller 22 for the stoppage of the installation, if necessary, when a transgression of the permissable maximum values occurs. The basic design of press frame can be used for presses with either top drive or bottom drive.

In the foregoing specification certain preferred embodiments and practices of this invention have been set out, however, it will be apparent that this invention may be otherwise embodied within the scope of the following claims.

I claim:

1. A frame for a hammer forging press having a horizontal forging axis, said frame consisting of two vertical U-shaped frame members, one on each side of the forging axis of said press, a bed extending obliquely between said frame member generally at a right angle to the forging axis, said vertical members being positioned at an oblique angle to said forging axis, a top transom above the forging axis on top of and connecting said vertical members, a bottom transom including said bed beneath the forging axis and beneath and connecting said vertical members and at least four vertical tie rods connecting the top and bottom transoms.

2. A frame for a hammer forging press as claimed in claim 1 wherein the vertical members are positioned at an angle of about 45° to the forging axis.

3. A frame for a hammer forging press as claimed in claim 1 wherein strain gauges on the tie rods monitor the stress therein.

4. A frame for a hammer forging press as claimed in claim 3 wherein the strain gauges activate means for stopping the press in the event a pre-selected stress is achieved.

5. A frame for a hammer forging press having a horizontal forging axis, said frame consisting of two vertical U-shaped frame members, one on each side of the forging axis of said press, said vertical members being positioned at an angle to said forging axis, a top transom above the forging axis on top of and connecting said vertical members, a bottom transom beneath the forging axis and beneath and connecting said vertical members and at least four vertical tie rods connecting the top and bottom transoms, wherein the tie rods are fully housed within the U-shaped side members, which side members are closed towards the forging axis to protect the tie rods against radiation from a work piece in the press.

* * * * *